US009263829B2

(12) United States Patent
Wu et al.

(10) Patent No.: US 9,263,829 B2
(45) Date of Patent: Feb. 16, 2016

(54) DURABLE PLUG CONNECTOR ASSEMBLY AND METHOD OF ASSEMBLING THE SAME

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/605,992

(22) Filed: Jan. 26, 2015

(65) Prior Publication Data

US 2015/0214680 A1 Jul. 30, 2015

(30) Foreign Application Priority Data

Jan. 24, 2014 (CN) ..... 2014 1 0032255

(51) Int. Cl.

| | |
|---|---|
| ***H01R 12/00*** | (2006.01) |
| ***H01R 13/627*** | (2006.01) |
| ***H01R 13/504*** | (2006.01) |
| ***H01R 13/66*** | (2006.01) |

(52) U.S. Cl.

CPC ..... *H01R 13/6271* (2013.01); *H01R 13/504* (2013.01); *H01R 13/6275* (2013.01); *H01R 13/6658* (2013.01)

(58) Field of Classification Search

USPC ..... 439/76.1, 607.56, 607.57, 607.47, 439/607.46

See application file for complete search history.

(56) References Cited

U.S. PATENT DOCUMENTS

| | | | | |
|---|---|---|---|---|
| 6,976,876 | B1 * | 12/2005 | Su | H01R 13/6583 439/507.57 |
| 7,717,749 | B2 * | 5/2010 | Chen | H01R 13/6658 439/76.1 |
| 8,562,369 | B2 * | 10/2013 | Wu | H01R 9/032 439/76.1 |
| 8,727,795 | B2 * | 5/2014 | Feyder | H01R 12/732 439/76.1 |
| 8,794,981 | B1 | 8/2014 | Rodriguez et al. | |
| 8,961,195 | B2 * | 2/2015 | Wu | H01R 13/6461 439/607.01 |
| 9,011,179 | B2 * | 4/2015 | Siahaan | H01R 13/504 439/607.57 |

FOREIGN PATENT DOCUMENTS

| | | |
|---|---|---|
| CN | 203193000 | 9/2013 |

* cited by examiner

*Primary Examiner* — Tho D Ta

(74) *Attorney, Agent, or Firm* — Wei Te Chung; Ming Chieh Chang

(57) ABSTRACT

A plug connector assembly for mating with a complementary connector includes a printed circuit board (PCB) defining a plurality of conductive pads, a pair of metal members mounted on two sides of the PCB and soldered with the PCB for electrically connecting with the complementary connector, an inserting member electrically connected on a front end of the PCB to connect to the complementary connector, and a housing enclosing the PCB. The PCB includes a front portion, an opposite rear portion, and a middle portion connecting the front portion and the rear portion. The conductive pads include a plurality of first pads disposed on the front portion. The inserting member includes an insulative member and a plurality of terminals held on the insulative member. The terminals are soldered with corresponding first pads.

9 Claims, 7 Drawing Sheets

DURABLE PLUG CONNECTOR ASSEMBLY AND METHOD OF ASSEMBLING THE SAME

BACKGROUND OF THE INVENTION

1. Field of the Invention

The present invention relates to a plug connector assembly, and more particularly to the assembling structure of the plug connector assembly. This application relates to the copending application Ser. No. 14/477,889 filed Sep. 5, 2014 having the same assignee with the instant application 2. Description of Related Arts China Patent No. 203193000, issued on Jan. 28, 2013, discloses a plug connector comprising an insulative body, a plurality of terminals held in the insulative body, a shielding member assembled around the insulative body, and a printed circuit board (PCB) soldered with the terminals and cable wires. Each terminal comprises a contacting portion and a soldering portion extending beyond the insulative body and soldered with the PCB. The shielding member also performs the function of latching the complementary connector.

U.S. Pat. No. 8,794,981, issued on Aug. 5, 2014, discloses a plug including a PCB (printed circuit board). The PCB includes signal contact pads, a plurality of pins electrically coupled and attached to the signal contact pads on a top and lower surfaces of the PCB, interior nodes on two sides thereof, and power nodes coupled to the interior nodes by, for example, soldering. An overmold is applied to the PCB to expose the pins and the power nodes for electrically connecting with a mating connector.

An improved plug connector assembly is desired to offer advantages over the related art.

SUMMARY OF THE INVENTION

An object of the present invention is to provide a plug connector assembly, and more particularly to a plug connector assembly with stable structure, strong durability and narrow and thin shape.

To achieve the above-mentioned object, a plug connector assembly for mating with a complementary connector includes a printed circuit board (PCB) defining a plurality of conductive pads, a pair of metal members mounted on two sides of the PCB and soldered with the PCB for electrically connecting with the complementary connector, an inserting member electrically connected on a front end of the PCB to connect to the complementary connector, and a housing enclosing the PCB. The PCB includes a front portion, an opposite rear portion, and a middle portion connecting the front portion and the rear portion. The conductive pads include a plurality of first pads disposed on the front portion. The inserting member includes an insulative member and a plurality of terminals held on the insulative member. The terminals are soldered with corresponding first pads.

According to the present invention, the plug connector assembly comprises the inserting members soldering with the PCB to become durable. The metal members mounted on two sides of the PCB to play the part of power terminal make the plug connector assembly narrow and thin. The housing comprises the spring tab soldering with the PCB to make the housing fix firmly with the PCB and increase the degree of the anti-bending of the plug connector assembly.

DETAILED DESCRIPTION OF THE PREFERRED EMBODIMENT

Figure 1:
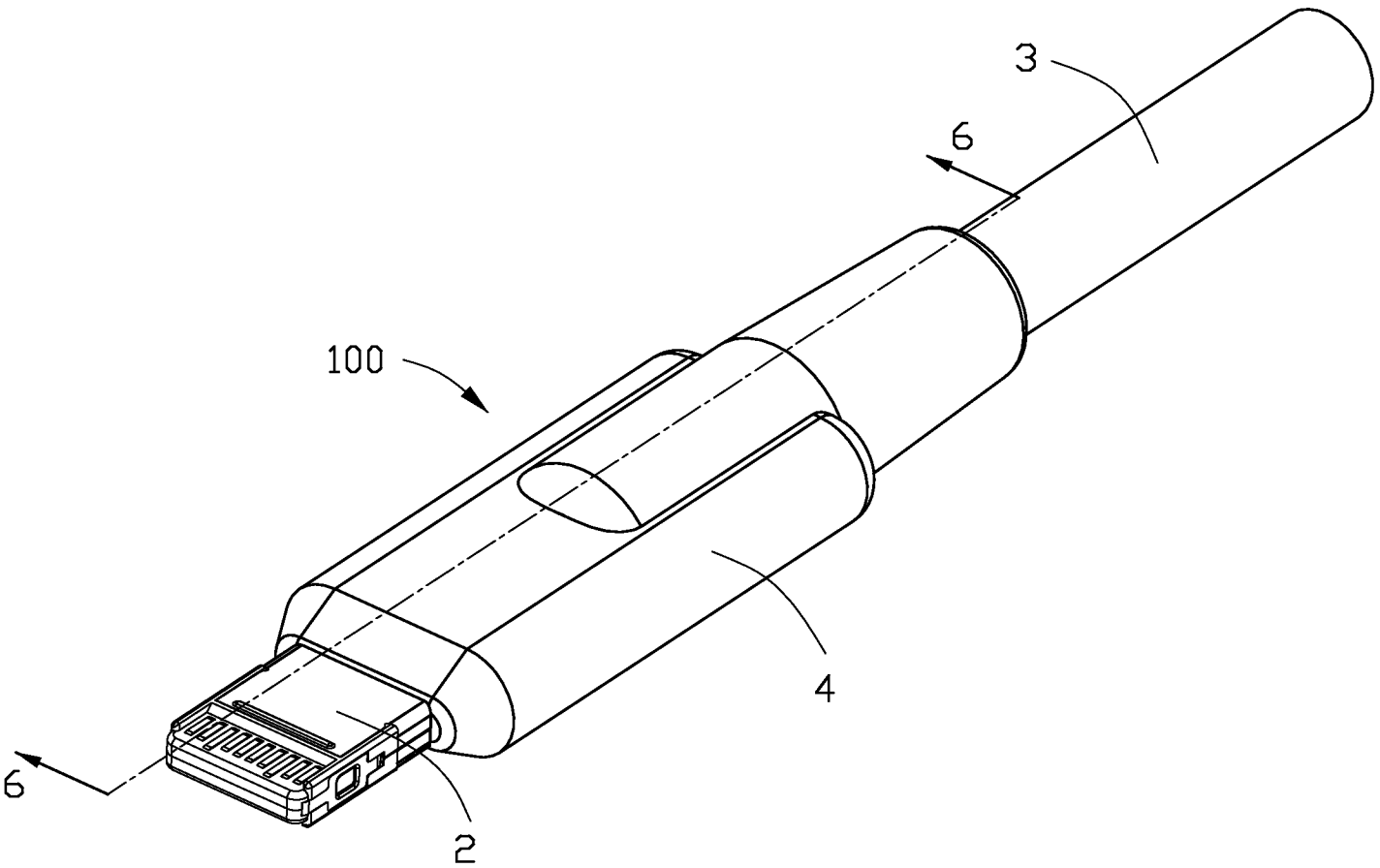
FIG. 1 is a perspective view of a plug connector assembly in accordance with the present invention.
Figure 2:
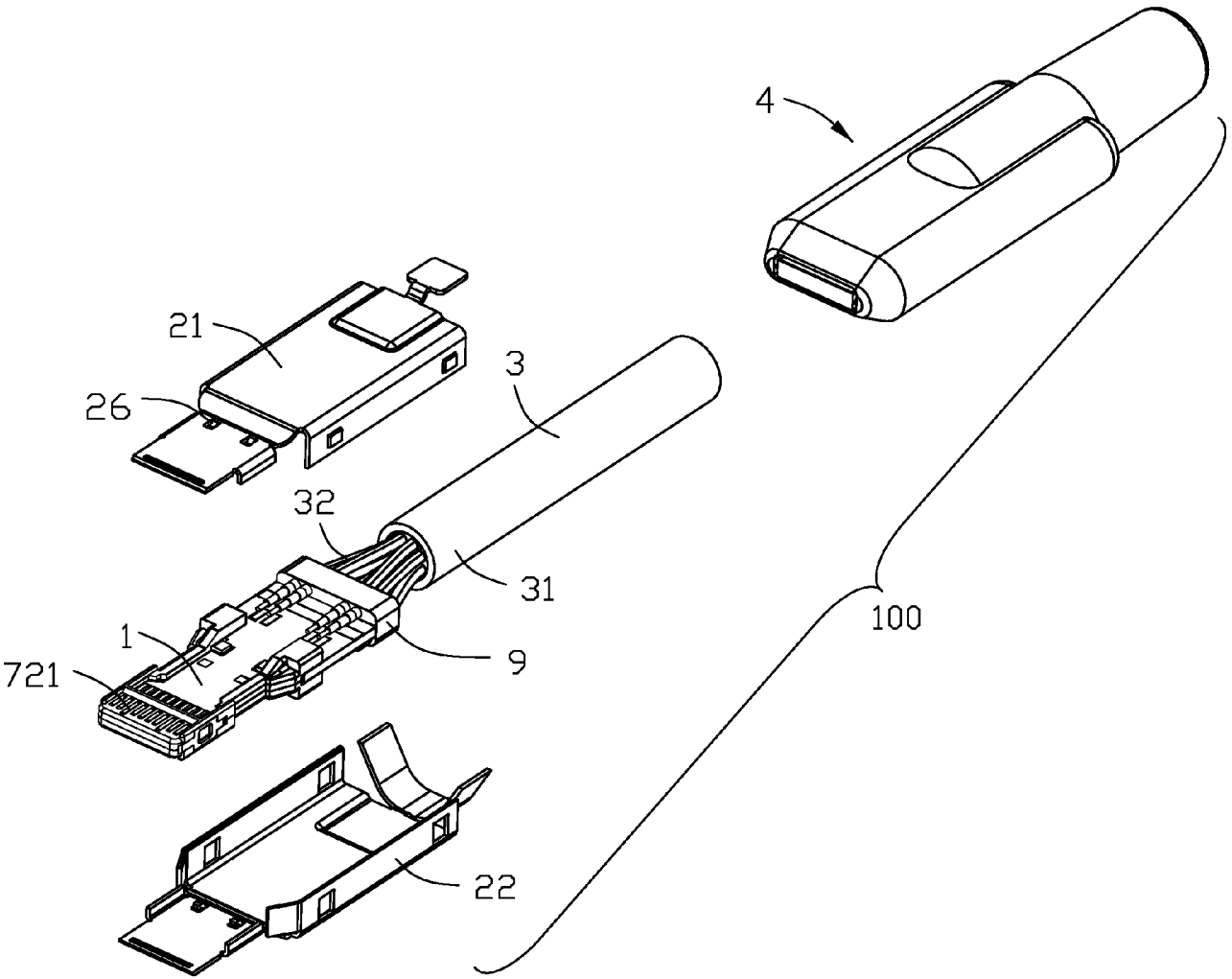
FIG. 2 is a partly exploded view of the plug connector assembly as shown in FIG. 1.
Figure 3:
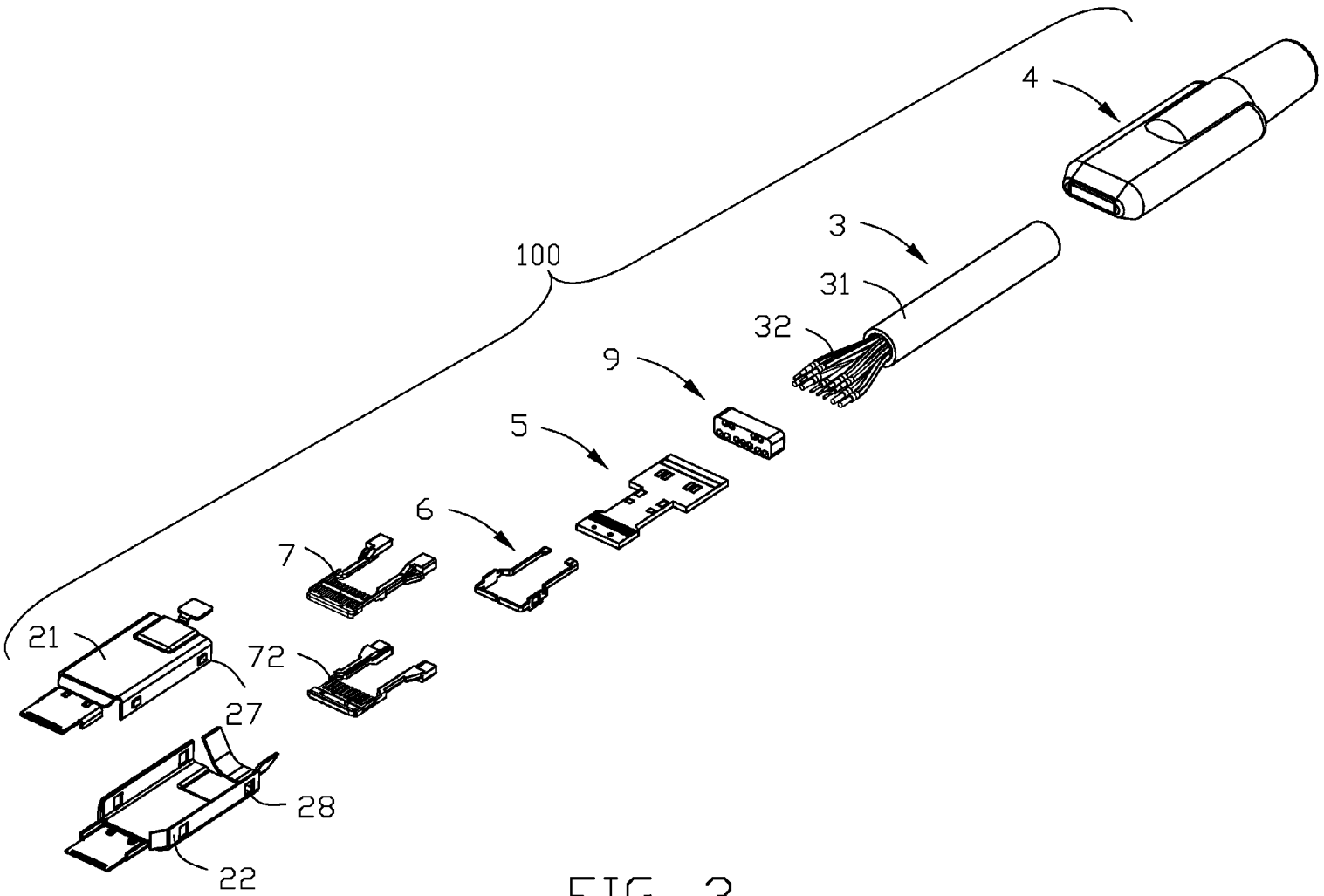
FIG. 3 is an exploded view of the plug connector assembly as shown in FIG. 1.
Figure 4:
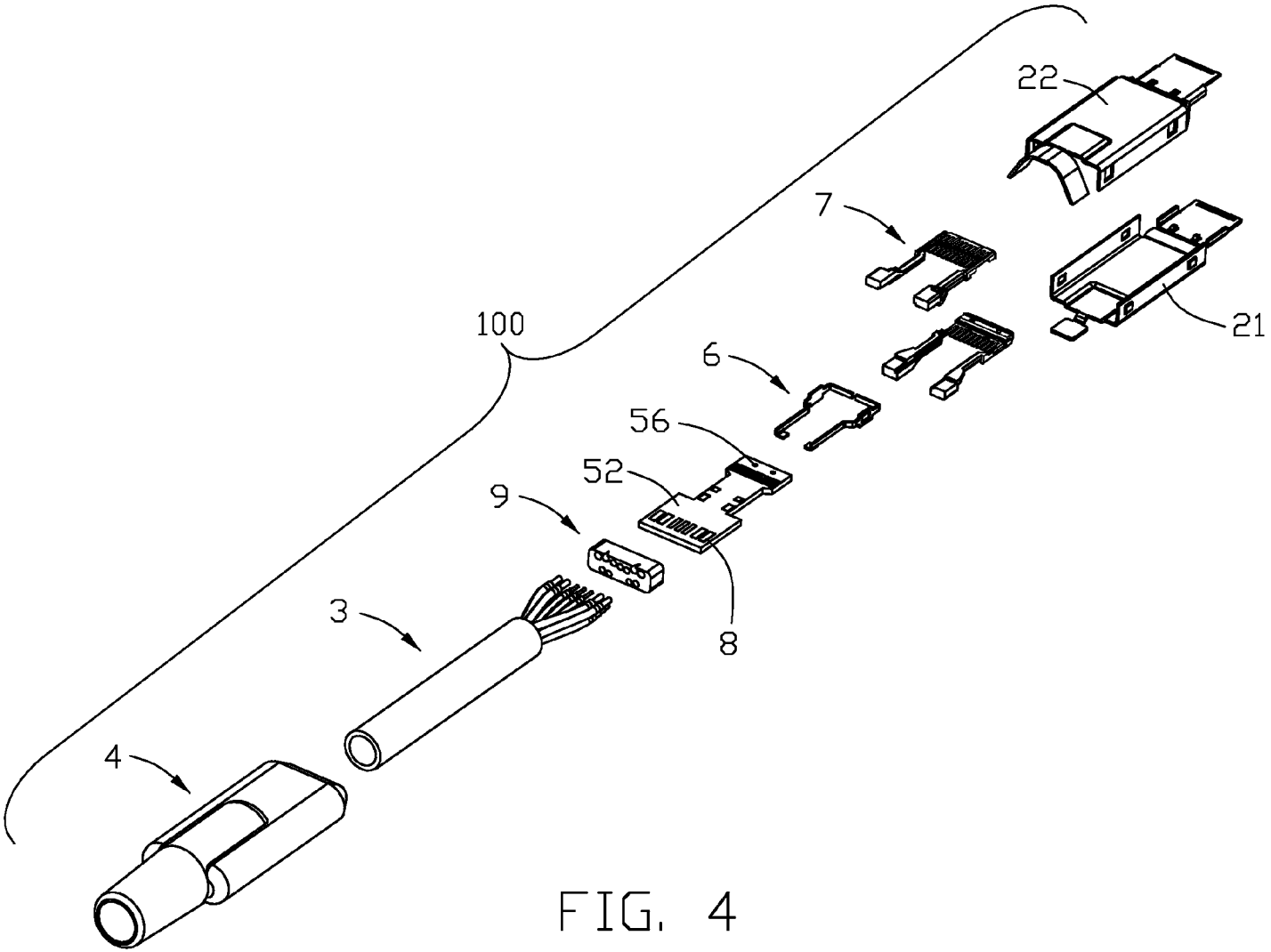
FIG. 4 is another exploded view of the plug connector assembly as shown in FIG. 3.

Reference will now be made in detail to some preferred embodiments of the present invention.

Referring to FIGS. 1 to 4, a plug connector assembly 100 for mating with a complementary connector (not shown) comprises a circuit board assembly 1, a housing 2 enclosing the circuit board assembly 1, a cable 3 extending from a tail end of the housing 2, and a cover 4 molded to the housing 2 and the cable 3. The circuit board assembly 1 comprises a printed circuit board (PCB) 5 defining a plurality of conductive pads 8, a pair of metal members 6 mounted on two sides of the PCB 5 and electrically connected with the complementary connector, and an inserting member 7 electrically connected on a front end of the PCB 5 for being connected to the complementary connector. In this embodiment, the metal members 6 are equivalent to power terminals.

Figure 5:
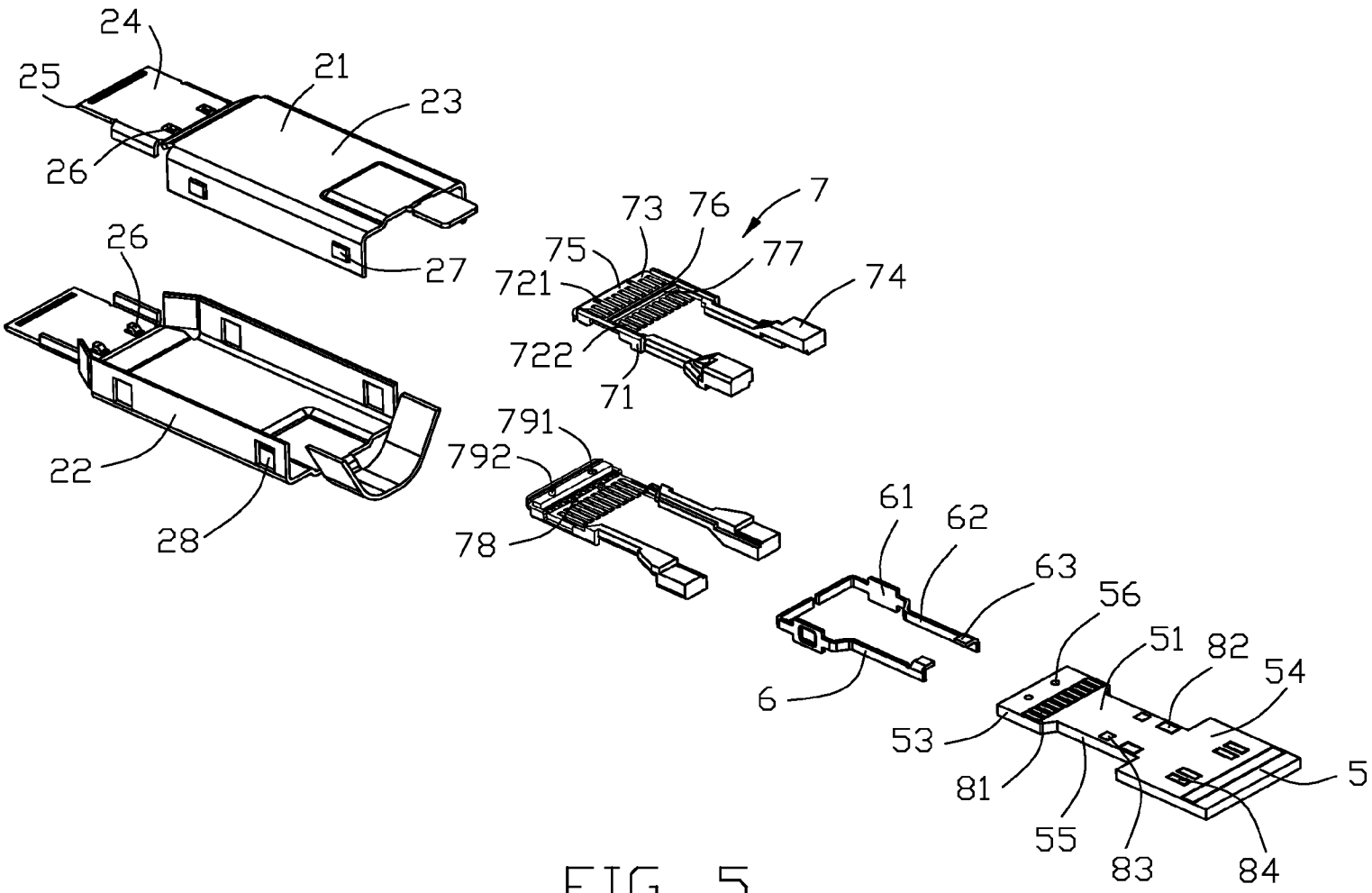
FIG. 5 is an exploded view of the circuit board assembly and the housing of the plug connector assembly as shown in FIG. 1.

Referring to FIG. 5, the housing 2 comprises an upper housing part 21 and a lower housing part 22. Each of the upper housing part 21 and the lower housing part 22 comprises a main portion 23 and a tongue portion 24 extending from the main portion 23. The tongue portion 24 comprises a receiving portion 25. The receiving portion 25 is a chamfer set inclined. The tongue portion 24 of the housing 2 proximal to the main portion 23 comprises a pair of spring tabs 26 bending inwardly. Side walls of the upper housing part 21 comprise a plurality of blockers 27. The lower housing part 22 comprises a plurality of openings 28 mating with the blockers 27 to fasten the upper housing part 21 and the lower housing part 22.

The cable 3 comprises an insulative layer 31 and a plurality of core wires 32 received in the insulative layer 31. A spacer 9 is disposed to separate the core wires 32 from each other.

The PCB 5 comprises an upper surface 51 and an opposite lower surface 52. The PCB 5 further comprises a front portion 53 soldered with the inserting member 7, an opposite rear portion 54, and a middle portion 55 connecting the front portion 53 and the rear portion 54. A size of the rear portion 54 is larger than the size of the middle portion 55. The conductive pads 8 comprise a plurality of first pads 81 disposed on the front portion 53, a plurality of second pads 82 and third pads 83 disposed on the middle portion 55, and a plurality of fourth pads 84 disposed on the rear portion 54 of the PCB 5. The spring tabs 26 of the housing 2 are soldered with the third pads 83, and the core wires 32 of the cable 3 are soldered with the fourth pads 84. The PCB 5 further comprises a pair of positioning holes 56 on the upper surface 51 and lower surface 52 respectively. The conductive pads 8 are also disposed on the front portion 53, the rear portion 54 and the middle portion 55 on the lower surface 52 of the PCB 5.

There are a pair of metal members 6 having the same structure and disposed on two sides of the middle portion 55 of the PCB 5. The metal members 6 are electrically connected with the complementary connector. Each metal member 6 comprises a latching portion 61 latching with the complementary connector, a pair of second arms 62 extending from the latching portion 61, and a soldering portion 63 disposed at the end of the second arm 62. The soldering portion 63 is formed by the second arm 62 extending vertically to the second arm 62 in a horizontal surface. The soldering portion 63 is soldered with the second pads 82 on the PCB 5.

There are a pair of inserting members 7 enclosing the PCB 5. One inserting members 7 is mounted on the upper surface 51 and soldered with the first pads 81 on the upper surface 51, and another is mounted on the lower surface 52 and soldered with the first pads 81 on the lower surface 52. The inserting member 7 comprises an insulative member 71 and a plurality of terminals 72 held on the insulative member 71. The insulative member 71 comprises a head portion 73 defining a top wall 75 and a pair of first arms 74 extending from two sides of the head portion 73. A length of the first arm 74 of the inserting member 7 is longer than the length of the second arm 62 of the metal member 6. Each terminal 72 comprises a contacting portion 721 exposed out of the top wall 75 of the head portion 73 for electrically contacting with the complementary connector and a connecting portion 722 extending beyond the top wall 75 and disposed between the pair of the first arms 74 for soldering with the first pads 81. The head portions 73 of the pair of inserting members 7 form the mating portions for connecting with the complementary connector to reduce the thickness of the plug connector assembly 100 and save the space. The terminals 72 on the inserting member 7 are arranged symmetrically to realize the insertion in two different directions.

Figure 6:
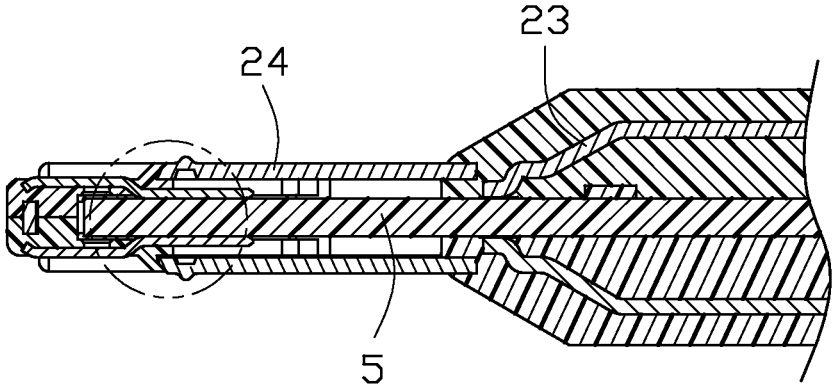
FIG. 6 is a cross-sectional view of the plug connector assembly taken along line 6-6 of FIG. 1.
Figure 7:
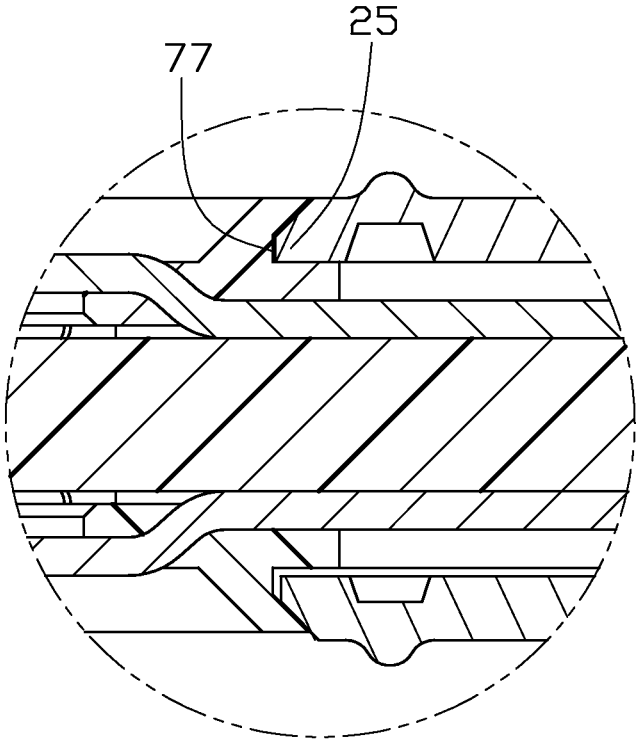
FIG. 7 is a partial enlarged view of the plug connector assembly as shown in FIG. 6.

The inserting member 7 comprises a stop wall 76 on transverse. A receiving slot 77 is formed between the stop wall 76 and the horizontal surface. Referring to FIGS. 6 and 7, the receiving portion 25 of the tongue portion 24 of the housing 2 is inserted into the receiving slot 77 to prevent the front end of the housing 2 from perking. The head portion 73 comprises a pair of positioning posts 78 mating with the positioning holes 56 of the PCB 5. The inserting member 7 mounted on the upper surface 51 comprises a mounting hole 791 and a mounting post 792, and the inserting member 7 mounted on the lower surface 52 comprises a mounting hole 791 and a mounting post 792 too. The inserting member 7 mounted on the upper surface 51 and the inserting member 7 mounted on the lower surface 52 fixed together by the mounting holes 791 and the mounting posts 792.

A method of manufacturing a plug connector assembly 100 is disclosed by this invention, comprising the steps as following. The core wires 32 of the cable 3 are soldered with the fourth pads 84 on the rear portion 84 of the PCB 5 firstly. The cable 3 also cab be soldered after assembling the circuit board assembly 1.

The pair of metal members 6 are soldered on two sides of the PCB 5 respectively. The metal member 6 is set on the side walls of the middle portion 55 of the PCB 5. The soldering portion 63 is contacting with the second pads 82, and then soldering the soldering portion 63 with the second pads 82.

The pair of the inserting members 7 are mounted on the upper surface 51 and the lower surface 52 of the PCB 2 respectively. The positioning post 78 is inserted into the positioning hole 56 of the front portion 53 of the PCB 5. The first arm 74 is coating the second arm 62 and mechanical mating with the PCB 5. The connecting portions 722 of the terminals 72 of the inserting member 7 are soldered with the first pads 81 on the front portion 53 of the PCB 5. The latching portion 61 of the metal member 6 exposed out of the head portion 73 of the inserting member 7 to solder with the complementary connector. When mounting the inserting members 7 on the PCB 5, the mounting hole 791 of inserting member 7 on the upper surface 51 is aligned to the mounting post 792 of inserting member 7 on the lower surface 52, and the mounting post 792 of inserting member 7 on the upper surface 51 is aligned to the mounting hole 791 of inserting member 7 on the lower surface 52.

The housing 2 is mounted receiving the PCB 5. The tongue portions 24 of the upper housing part 21 and the lower housing part 22 are inserted into the receiving slots 77 of the head portion 72 of the inserting member 7 to prevent the front end of the housing 2 from perking. The blockers 27 disposed on the side wall of the upper housing part 21 are clamping with the openings 28 of the lower housing part 22. The spring tabs 26 of the housing 2 are soldered with the second pads 82 of the PCB 5. After assembling the upper housing part 21 and the lower housing part 22, the crevice between the upper housing part 21 and the lower housing part 22 is soldered by the laser to increase the anti-bending strength of the plug connector assembly 100. The cover 4 is molded to the housing at last.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly for mating with a complementary connector, comprising:

a printed circuit board (PCB) defining a plurality of conductive pads, the PCB comprising a front portion, an opposite rear portion, and a middle portion connecting the front portion and the rear portion, the conductive pads comprising a plurality of first pads disposed on the front portion;

a pair of metal members soldered to two sides of the PCB for electrically connecting with a complementary connector;

an inserting member electrically connected on a front end of the PCB for connecting to the complementary connector, the inserting member comprising an insulative member and a plurality of terminals held on the insulative member, the terminals soldered with corresponding first pads; and a housing enclosing the PCB;

wherein the insulative member comprises a head portion defining a top wall and a pair of first arms extending from two sides of the head portion, each terminal comprising a contacting portion exposed out of the top wall of the head portion for electrically contacting with the complementary connector and a connecting portion extending beyond the top wall and disposed between the pair of the first arms for soldering with the first pads.

2. The plug connector assembly as recited in claim 1, wherein the conductive pads comprise a plurality of second pads disposed on the middle portion of the PCB, and the metal member comprises a latching portion for latching with the complementary connector, a second arm extending from the latching portion, and a soldering portion disposed at the end of the second arm and soldered with the second pads.

3. The plug connector assembly as recited in claim 1, wherein the PCB comprises an upper surface and an opposite lower surface each comprising the first pads, and there are a pair of inserting members enclosing the PCB, one inserting member mounted on the upper surface and soldered with the first pads on the upper surface, and the other inserting member mounted on the lower surface and soldered with the first pads on the lower surface.

4. The plug connector assembly as recited in claim 3, wherein each inserting member comprises a stop wall in a transverse direction, a receiving slot formed between the stop wall and a horizontal surface, and the housing comprises an upper housing part and a lower housing part, each housing part comprising a main portion and a tongue portion extending from the main portion, the tongue portion comprising a receiving portion inserted into the receiving slot to prevent the front end of the housing from perking.

5. The plug connector assembly as recited in claim 4, wherein the conductive pads further comprise a plurality of third pads disposed on the middle portion of the PCB, and the tongue portion of the housing comprises a spring tab proximal to the main portion of the housing and bending inwardly to solder with the third pads.

6. A method for manufacturing a plug connector assembly, comprising the steps of:

providing a printed circuit board (PCB) defining a plurality of conductive pads;

mounting a pair of metal members on two sides of the PCB;

mounting a pair of inserting members on the PCB, each inserting member comprising an insulative member and a plurality of terminals held on the insulative member, the insulative member comprising a head portion and a pair of first arms extending from two sides of the head portion, each inserting member comprising a receiving slot, the terminals soldered with the corresponding conductive pads, the first arms mechanically mating with the PCB;

assembling a housing to enclose the PCB; and molding a cover to the housing; wherein each metal member comprises a latching portion for latching with the complementary connector, a second arm extending from the latching portion, and a soldering portion disposed on the end of the second arm and soldered with the conductive pads to fix the metal member on the PCB.

7. The method as recited in claim 6, wherein the step of assembling comprises inserting a front end of the housing into the receiving slot of the inserting member to prevent the front end from perking.

8. The method as recited in claim 6, wherein the housing comprises an upper housing part and an opposite lower housing part, the upper housing part soldered with the lower housing part after assembling to increase the anti-bending strength of the plug connector assembly.

9. An electrical connector comprising:

a pair of inserting members stacked together with a plate sandwiched therebetween around corresponding rear portions of said pair of inserting members in a vertical direction, each of said inserting member including an insulative member with a plurality of contacts embedded therewith via an insert molding process; wherein front contacting sections of the contacts are exposed to an exterior in the vertical direction;

a pair of metallic shells enclosing the plate and rear portions of the inserting members; and a metal member surrounding a periphery of the pair of inserting members with a pair of locking recesses on two lateral sides for locking with a corresponding latch of a complementary connector; wherein the insulative member forms a recess in which a front end of the corresponding shell is received so as to prevent the shell from being withdrawal from the insulative member in said vertical direction; wherein the plate is a printed circuit board on which the contacts are soldered.

* * * * *